US005853306A

United States Patent [19]

Worth et al.

[11] Patent Number: 5,853,306

[45] Date of Patent: Dec. 29, 1998

[54] OPERATION OF MARINE ENGINES

[75] Inventors: David Richard Worth, Shenton Park; Thomas Schnepple, Wembly; Stephen Reinhard Malss, Woodvale, all of Australia

[73] Assignee: Orbital Engine Company (Australia) Pty Limited, Balcatta, W.A., Australia

[21] Appl. No.: 767,500

[22] Filed: Dec. 16, 1996

[30] Foreign Application Priority Data

Dec. 15, 1995 [AU] Australia ..... PN 7169

[51] Int. Cl.[6] ..... B63H 21/21

[52] U.S. Cl. ..... 440/1; 477/101; 477/109

[58] Field of Search ..... 440/1, 86, 87; 477/101, 102, 105, 107, 109, 110

[56] References Cited

U.S. PATENT DOCUMENTS

| | | | |
|---|---|---|---|
| 4,061,056 | 12/1977 | Iizuka et al. | 477/107 |
| 4,262,622 | 4/1981 | Dretzka et al. | 440/86 |
| 4,843,914 | 7/1989 | Koike | 477/109 |
| 4,973,274 | 11/1990 | Hirukawa | 440/1 |
| 5,043,894 | 8/1991 | Yamaguchi | 477/109 |
| 5,374,224 | 12/1994 | Huffmaster et al. | 477/181 |
| 5,403,246 | 4/1995 | Umemoto | 477/101 |

OTHER PUBLICATIONS

Patent Abstracts of Japan M–1450, p. 76, JP,A, 5–71384 23 Mar. 1993.

Patent Abstracts of Japan, JP,A, 07083087, 28 Mar. 1995.

Patent Abstracts of Japan, JP,A, 07127553, 16 May 1995.

*Primary Examiner*—Sherman Basinger

*Attorney, Agent, or Firm*—Nikaido, Marmelstein, Murray & Oram LLP

[57] ABSTRACT

Disclosed is a method of operation of a marine engine comprising sensing an operator demand for a gear-shift and, in response to the sensing of said operator demand, varying the engine torque profile to enable said gear-shift. Typically, the engine torque profile is required to be varied to overcome forces resistive to gear-shift.

31 Claims, 2 Drawing Sheets

OPERATION OF MARINE ENGINES

Figure 1:
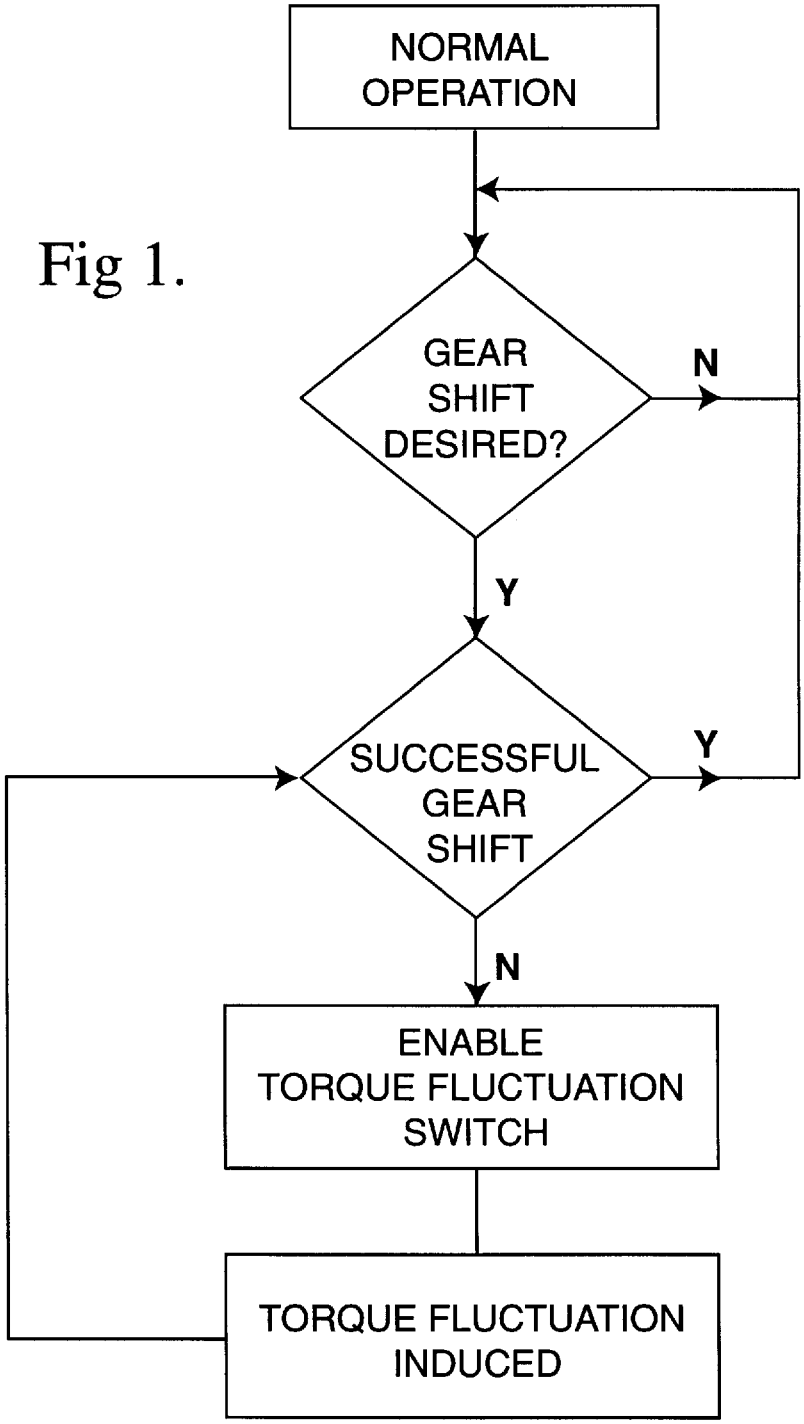

The present invention relates to a method of operation for marine engines and, in particular, to a method for improving the operation of marine engines upon the sensing of a demand by an operator for a gear change.

Marine engines have typically a forward and reverse gear. In some cases, upon sensing demand for a change out of gear in conventional marine engines, a switch is enabled in response to which ignition of a combustible mixture within a cylinder or cylinders of the engine is retarded. This generally causes a torque fluctuation or drop in torque of sufficient magnitude and/or duration to enable the engine to drop out of gear. On engaging a gear, some form of feed forward control may be applied to counteract the extra load placed on the engine as resulting from a gear-shift.

Generally however, problems with gear-shift in marine engines are more likely to be associated with disengaging a gear. In this regard, many marine engines have the aforementioned gear-shift switch such that it is only active when excess pressure is applied to the shift mechanism. If the switch is not engaged, the engine runs normally. Further, certain standard outboard marine engines, whilst idling, or returning to idle operation, typically run quite rich with ignition retarded by a certain level such that naturally occurring torque fluctuations provide the opportunity for the meshing gears within the gearbox of such marine engines to disengage.

However, retardation of ignition is not conducive to good operation of an engine and typically results in the engine running particularly rough. Essentially, the engine is made to actually drop In torque output and typically drops a significant amount in regard to engine speed. For example, the engine speed can drop several hundred rpm and there is a greater susceptibility to stalling. Further, as ignition occurs late, less power is transmitted to the crankshaft by firing of the combustible mixture. Also, emissions may be expected to be higher as late ignition is typically not conducive to efficient combustion.

The physical nature of typical marine engine gearboxes partly explains the need for a certain level of torque fluctuation before the gearbox gears will disengage. Dog clutches which are normally used in these gearboxes and which provide for a robust, low maintenance, inexpensive means to engage and disengage gears, unlike the most common automotive clutches, have dog teeth around the outer mating clutch surfaces. When two of these dog clutches are brought together, the dog teeth from the opposing clutches engage and tend to pull together. The teeth are normally square cut so that in order for the clutches to separate, the operator needs to overcome any friction forces between the contacting surfaces of the dog teeth. In fact, in some instances, the teeth have a slight taper to hold the clutches together thus aggravating the problem of disengagement.

Accordingly, as the load transmitted by the clutches increases, there will be an increased frictional force that is required to be overcome in order to separate the clutches. Further, the fact that a propeller is attached to the output clutch would typically make it more difficult to disengage the clutches as the propeller will provide a relatively even and constant load to the clutches. Hence, the engaging dog teeth of the clutches are more likely to be operating with an even loading on the relevant dog teeth surfaces and thus there is more likely to be a constant frictional force which must be overcome.

It is hence evident that for engines which run with a smooth cyclic torque such as engines incorporating the Applicant's patented fuel injection technology such as U.S. Pat. No. 4,693,224, issued Sep. 15, 1987 or U.S. Pat. No. 4,800,862, issued Jan. 31, 1989 or U.S. Pat. No. 4,807,572, issued Feb. 28, 1989, a reliable method is required by which the gearbox gears may be disengaged without severely compromising the operation or performance of the engine. This is not considered a significant problem on conventional two-stroke marine engines due to their typically rich and retarded mode of operation at idle.

It is therefore the object of the present invention to provide a method of operation for a marine engine which enables satisfactory gear-shift out of or into either forward or reverse gears while enabling more efficient engine performance than occurs in conventional marine engines.

With this object in view, the present invention provides a method of operation of an internal combustion engine comprising sensing an operator demand for a gear-shift and, in response to the sensing of said operator demand varying the engine torque profile to enable said gear-shift. Typically, the engine torque profile is required to be varied to overcome forces resistive to gear-shift.

Preferably, the engine torque profile is varied such that the mean engine speed is maintained. Conveniently, the engine is one in which gear-shift occurs when the engine speed is approaching idle, or is at idle. However, the invention is not limited to gear-shifts at idle.

Preferably, operator demand for a gear-shift or a desire to come out of gear is sensed by a suitable sensor and the variation in engine torque, typically a controlled torque fluctuation, is sufficient to enable gear-shift to be effected. Conveniently, when the operator of the engine desires to shift gear or drop out of gear, this is sensed and a switch is enabled. On enablement of the switch, an engine control unit provides a signal causing the engine torque profile to vary due to deliberate induction of a torque fluctuation.

The torque fluctuation may preferably be instantaneous and be achieved in a number of ways. In a preferred manner, the fuel delivery event to at least one engine combustion chamber in the case of a direct injected engine, may be prevented. That is, at least one engine cylinder is shutdown such that no fuel is delivered into a selected combustion chamber of the engine. Alternatively, but less desirably, given the likely adverse impact on combustion efficiency of excess fuel in the cylinder, the ignition event within a selected combustion chamber may be retarded, otherwise varied or prevented from occurring. In a further alternative, at least one engine cylinder may be deliberately caused to misfire. Such a misfire may be caused by altering injection timings of either fuel and/or air injection depending upon the nature of the injection system. (ie: air injection may be altered or ceased in a two-fluid injection system such as that described in the U.S. Pat. No. 4,934,329). Alternatively, if individual control of the air-flow to each cylinder of a multi-cylinder engine is provided, the air-flow to at least one cylinder may be varied, or ceased.

Nonetheless, it is not necessary that a single cylinder be shutdown. Where the engine comprises banks of cylinders, optionally in V-configuration, possibly involving 6 cylinders, an entire bank of cylinders may be shutdown. Alternatively, if there are more than two cylinders in a multi-cylinder engine, every second cylinder may be shutdown. Preferably, in a multi-cylinder engine having more than two cylinders, every second firing of each engine cylinder may be stopped or altered to cause the required torque fluctuation in response to engine operator demand for a gear shift.

Preferably, the change in the engine torque profile is brought about such that the mean output torque of the engine is maintained. Hence, even though the operation of at least one cylinder may be shutdown, the engine preferably maintains its initial engine speed and mean torque. Conveniently, in the case where the engine was initially idling to enable a gear-shift to be attempted, the engine preferably maintains its initial idle speed.

The ability to vary the overall torque profile of the engine while maintaining the speed and mean torque thereof is possible due to the sophistication of the Applicant's patented direct injection engine technology such as shown in U.S. Pat. No. 4,807,572, issued Feb. 28, 1989 or in U.S. Pat. No. 4,934,329, issued Jun. 19, 1990, and similar systems. Even though one cylinder, for example, may be shutdown or operating in a modified manner, the mean output torque and engine speed can be maintained by increasing the fuelling level to some or all of the remaining cylinders. Hence, unlike the process in conventional marine engines which causes an overall drop in engine torque and effectively causes each cylinder to run inefficiently, the present invention provides that normal combustion can be maintained for the operational cylinders. This is true whether at least one cylinder, or a bank of cylinders, is shutdown.

On this basis, the torque profile may be varied such that, considering for example a V6 engine, there no longer is a combustion event every 60° of crank-angle rotation. Where one bank of cylinders is shutdown (ie: every second firing cylinder), a combustion event occurs every 120° of crank-angle rotation. Hence, In regard to the instantaneous torque, rather than a peak torque reading occurring every 60°, this occurs every 120°.

More preferably, a strategy wherein two consecutively firing cylinders are shutdown for the same V6 engine results in a portion of one crank-angle cycle having maximum torque outputs 180° apart. The other portion of the crank-angle cycle comprises 4 maximum torque outputs 60° apart. Hence, a significant change has been made to the torque profile of the engine resulting in an instantaneous torque fluctuation which enables a desired gear-shift to be affected.

Importantly, unlike the previous example wherein an entire bank of cylinders was shutdown, this latter example results in a non-periodic torque profile for the engine which may be more conducive to enabling gear-shift than the previous periodic torque profile.

It is to be noted that in the cases where one or more cylinders are shutdown, the output torque of the remaining operational cylinders will increase by a certain amount due to the increased fuelling rate thereof. Accordingly, the mean engine torque and hence the engine speed is able to be maintained.

In a further aspect of the invention there is provided a control system for an internal combustion engine comprising means for sensing operator demand for a gear-shift, and means for varying the torque profile of said engine to overcome forces resistive to gear-shift in response to sensing of said operator demand for a gear-shift.

A sensor for sensing engine operator demand may be provided in the form of a lever or other suitable mechanism which the operator moves or actuates on shifting gear which triggers the gear-shift actuation switch. The sensor may be designed to respond to force applied by the operator exceeding a certain threshold. Force below the threshold will not actuate the switch. Hence, if the application of only a small force is necessary to effect gear-shift, the switch enabling the torque fluctuation need not be triggered.

If desired, the switch may be provided in the form of a shift or gear switch which causes at least one cylinder of the engine to drop out, and causes a change in the torque profile, when a gear change is attempted. That is, rather than have the switch indicating whether the engine is in or out of gear, the switch can be arranged to be activated when a gear-shift is attempted. Typically, such a switch is a pressure based switched and causes a change in the engine torque profile for as long as it is activated.

As alluded to hereinbefore, as engine speed gets higher, it becomes more difficult to affect a gear-shift and hence the engine torque profile needs to be modified for a longer time to ensure a reliable gear-shift. Conversely, at low engine speed, a gear-shift may reliably occur over a shorter time. Hence, particularly in the case where the shift switch is not a pressure based switch indicating when a gear-shift is being attempted, rather than the shift switch being arranged to cause a change in the engine torque profile for a maximum time regardless of engine speed, the change in torque profile as initiated by the shift switch may be made engine speed dependent.

Hence, at low engine speed for example, the change in the engine torque profile is not maintained for the same amount of time as it would be for higher engine speeds. This is particularly applicable where the switch is a neutral switch rather than a shift switch which may only cause a change in the engine torque when it is difficult to get into or out of gear. Such a neutral switch may only provide a signal indicative that the engine has just come out of gear and hence the change in torque profile needs to be applied for some predetermined time to enable a reliable gear-shift.

The engine itself may be of two-stroke type, but the invention is equally applicable to other engines such as four stroke engines, particularly marine engines.

Figure 2:
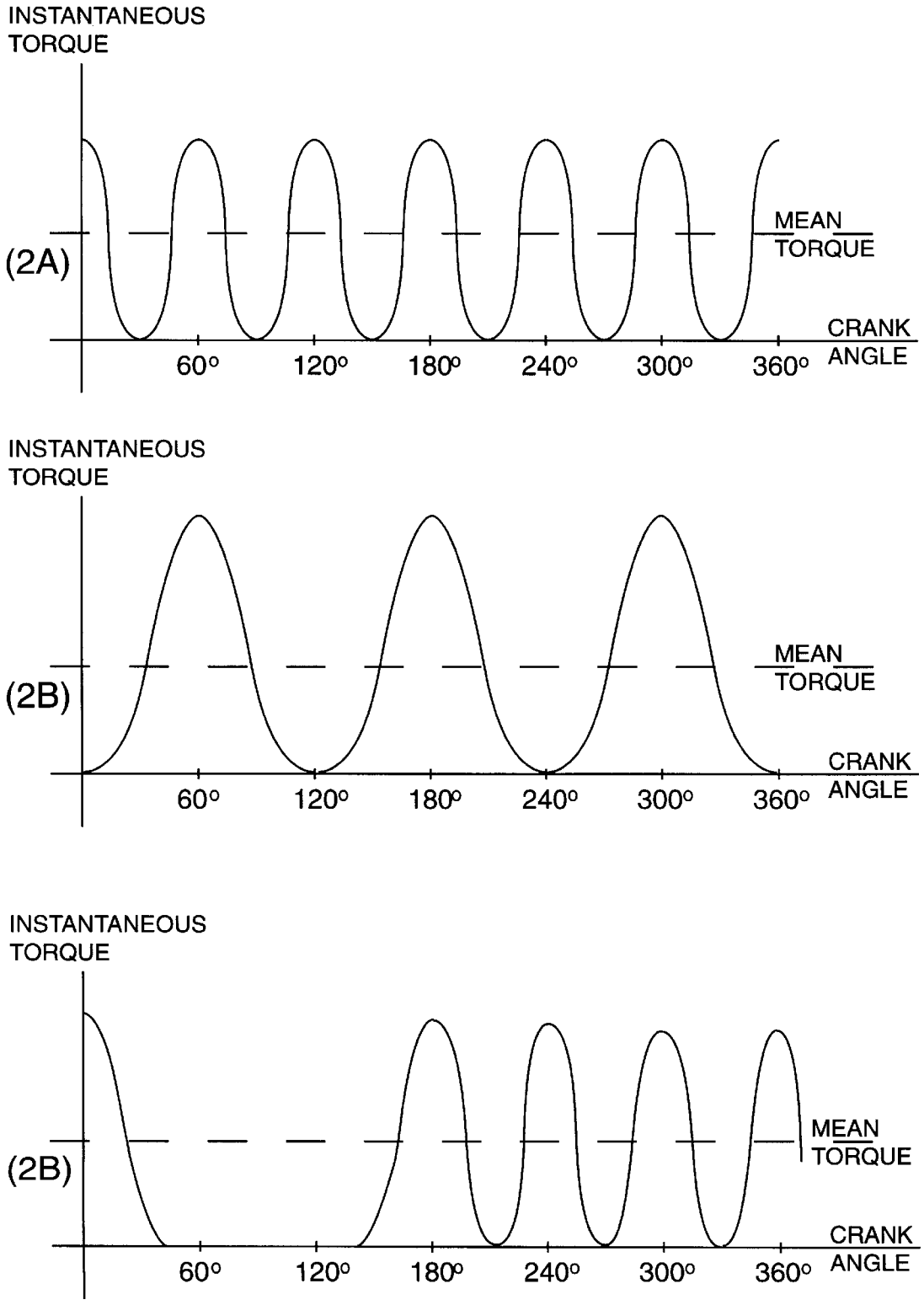

The invention may be better understood from the following description of preferred embodiments thereof made with reference to the accompanying drawings in which:

FIG. 1 is a flowchart of the method in accordance with the present invention; and FIG. 2 is a graph of instantaneous torque output for an engine (a) operating under normal conditions, (b) adopting the method of operation of the present invention wherein a bank of cylinders is shutdown, and (c) adopting the method of operation of the present invention wherein two consecutive cylinders are shutdown.

Referring now to FIG. 1, there will now be discussed a flowchart outlining the steps by which the method of the invention is used.

Firstly, the method is enabled in response to the desire, for example, by the operator of a boat employing an engine in which the method is implemented, to shift gear or to come out of gear. The operator moves a gear lever and this move in gear lever position is sensed by a sensing means and the electronic control unit (ECU), otherwise of conventional type, governing the operation of the engine sets a flag indicating the desire to shift or come out of gear.

Typically, the nature of operation of the engine is such that a gear-shift cannot occur unless the engine speed is at, or approaching, idle, however it is envisaged that this embodiment of the invention is applicable at off-idle engine speeds.

As mentioned hereinbefore, the flag indicating the operator's desire to shift or come out of gear may only be set if the force applied to the gear lever exceeds a certain threshold value. Thereafter, the flag may be set in response to a switch being triggered when the necessary force is applied to the gear lever. That is, the gearshift switch in this example is a pressure based switch. In such an arrangement, the applied force over and above the threshold value may result in the whole gear lever mechanism moving to trigger the switch and hence set the flag. If a force less than the threshold value is sufficient to cause the gear-shift, the gear lever mechanism as a whole does not move and hence the switch is not triggered and the flag is not set.

In the next step, the ECU will shut-down one or more cylinders of the engine by preventing, for example, introduction of fuel to the cylinder, or less advantageously, preventing ignition following introduction of the fuel to the cylinder of the engine. The shutting down of the one or more cylinders is effected in such a way as to interrupt the smooth running of the engine, however, the engine idle speed is typically maintained at the previous level.

The ECU may then sense whether the gear-shift or disengagement has been satisfactorily completed by a suitable detector. If not, the sequence of events above may be repeated as it is apparent that the torque fluctuation caused by shut-down of the one or more cylinders of the engine may not have been sufficient to enable disengagement of the dog clutches of the gearbox. In the case where a different switch such as a neutral switch is used, a certain time period may be set over which a torque change occurs and within which the gear-shift can occur whereafter the torque profile returns to its normal state.

If the gear-shift or disengagement has been satisfactorily completed, the method, implemented as a control routine for the ECU, may be disabled until the next occasion that the operator of the engine wishes to change or disengage from a gear.

The above description is intended to provide a general elucidation of the method of the invention. However, there now follows a more detailed description of the manner in which the method may be utilised to overcome the problem of resistance to disengagement of the dog clutches of a gearbox in response to an operator's desire for a gear change.

The outboard marine engine may be of the two-stroke cycle type having multiple cylinders, which may be arranged in banks, such as in a V6 configuration. Under typical operating conditions, a fuel-air mixture is introduced, with appropriate timing, into the combustion chambers of the engine and combusted to propel a boat. The characteristic of instantaneous torque against crank-angle for these typical operating conditions is shown in FIG. 2(*a*). It can be seen that a periodic maximum torque output occurs every 60° of crank-angle when operating in this fashion.

When gear-shift or disengagement is required by the operator, a single cylinder may be shutdown every 120° of rotation of the crankshaft or every second cylinder may be shut down until the gear-shift or disengagement is satisfactorily completed. Alternatively, an entire bank of cylinders, in an engine employing cylinders in banks, may be shutdown. One method may see every second cylinder skip-fired. Hence, for example, on a V6 engine, rather than a combustion event occurring every 60° of crankshaft revolution, a combustion event occurs every 120° during every second set of firing pulses. Depending on the cylinder firing order of the engine, this may mean that effectively one bank of cylinders of the V6 is shutdown. In this regard, the Applicant has found that such a V6 engine can still be made to run satisfactorily even though one bank of cylinders has effectively been shutdown.

The shutdown of one bank of cylinders of a V6 engine has the impact on the instantaneous torque characteristic as shown in FIG. 2(*b*). As alluded to hereinbefore, the fuelling level to the operational cylinders is increased such that the maximum torque output of each operational cylinder is increased as shown. Hence, overall, the mean torque output for the engine is maintained at the same level as shown in 2(*a*). However, the resultant periodic torque profile now provides for a 120° gap between consecutive firing events and hence an opportunity to shift or come out of gear.

Alternatively, rather than a bank of cylinders being shutdown, a number of consecutive cylinders can be shutdown. FIG. 2(*c*) shows the resultant instantaneous torque profile for the situation where 2 consecutive cylinders are shutdown.

As in the previous case, in order to maintain the idle speed and the mean output torque for the engine, the fuelling level to the operational cylinders is increased. In this case where the engine is operating at idle, this is typically achieved by way of a PID or idle controller. Due to the lesser number of cylinders which are shutdown, the individual torque output for each cylinder is not as great as in FIG. 2(*b*), but is greater than is the case in FIG. 2(*a*). However, there is now created a non-periodic torque profile which provides for 180° of crankshaft revolution within which a gear-shift can occur.

Importantly, for both of the previous alternatives, normal combustion is maintained in the operational cylinders. This is typically not the case in conventional marine engines which are made to run inefficiently with unstable combustion.

The change in torque profile caused by the shutdown of the cylinders, as described with reference to the previous embodiments, is conducive to avoidance of the problem of the gears or dog clutches remaining meshed due to frictional forces because the variation in torque in response to a desired gear change or disengagement enables the gear mechanism to be actuated more smoothly with less interruption to the satisfactory running of the engine. That is, an instantaneous torque fluctuation large enough for the gears or clutches of the gearbox to reduce the pressure on their meshing surfaces and drop apart is induced. This Is achieved whilst maintaining the previous engine idle speed and mean output torque.

Further, it is important to note that even though the frictional forces between the dog clutches is likely to increase at higher off-idle engine speeds (ie: the gears tend to pull together), it is envisaged that some benefit may be achieved by the use of the present invention if a change of gear into or out of gear at such higher engine speeds was possible. This would of course require that the gear select and throttle were not connected as in conventional marine engines which normally require that a gear is engaged at idle before the operator demand is increased.

It is not essential that cylinder shutdown occur by shutting down a fuel supply to the cylinder, though this would generally be preferred. The ECU simply prevents fuel injection occurring and one combustion event is avoided. Alternative methods such as preventing ignition or "leaning out" a cylinder by supplying less fuel and/or additional air when the gearshift is desired may have a similar effect.

Although the invention may preferably be implemented in a direct injected engine, this is not essential and the invention is equally applicable to manifold injected or carburetted engines.

Equally, the invention is not restricted in its application to two-stroke cycle engines. The invention may be implemented in four-stroke cycle engines.

The foregoing description is only intended to exemplify the invention. Other variations and modifications thereof are possible which do not depart from the scope of the invention.

We claim:

1. A method of operation of an internal combustion engine comprising sensing an operator demand for a gear-shift and, in response to the sensing of said operator demand, varying the engine torque profile while maintaining a mean engine output torque to thereby enable said gear-shift to be effected.

2. A method as claimed in claim 1 wherein the engine torque profile is varied such that mean engine speed is maintained.

3. A method according to claim 1 wherein the engine is one in which gear-shift occurs where the engine speed is approaching idle, or is at idle.

4. A method as claimed in claim 1 wherein engine torque profile is varied to produce a torque fluctuation.

5. A method as claimed in claim 1 wherein on sensing an operator demand for a gear-shift, a switch is enabled causing said engine torque profile variation.

6. A method according to claim 1 wherein the variation in the engine torque profile is instantaneous.

7. A method as claimed in claim 1 wherein the torque profile is varied by preventing a fuel delivery event to at least one engine combustion chamber.

8. A method as claimed in claim 1 wherein the torque profile is varied by not delivering fuel to a selected combustion chamber of the engine.

9. A method as claimed in claim 8 wherein the mean output torque is maintained by increasing the fuelling level to the remaining operational cylinder(s).

10. A method as claimed in claim 8 wherein, in the event that a gear-shift is not completed, the method is repeated.

11. A method as claimed in claim 1 wherein the torque profile is varied by prevention of an ignition event within a selected combustion chamber.

12. A method as claimed in claim 1 wherein the torque profile is varied by retarding the ignition timing for one or more engine cylinders.

13. A method as claimed in claim 1 wherein the torque profile is varied by altering the ignition timing for one or more engine cylinders.

14. A method as claimed in claim 1 wherein the torque profile is varied by causing at least one engine cylinder to misfire.

15. A method as claimed in claim 1 wherein said torque profile is varied by altering the injection timing of fuel and/or air to at least one engine cylinder.

16. A method as claimed in claim 1 wherein the torque profile is varied by varying or ceasing the air flow to at least one engine cylinder.

17. A method as claimed in claim 1 wherein the torque profile is varied by leaning out at least one engine cylinder by delivering less fuel and or additional air to said cylinder.

18. A method as claimed in claim 1 wherein said engine comprises at least two banks of cylinders and the torque profile is varied by shutting down one said bank.

19. A method as claimed in claim 1 wherein said engine is a multi-cylinder engine having more than two cylinders in which the torque profile is varied by shutting down every second cylinder.

20. A method as claimed in claim 1 wherein the torque profile is varied by shutting down cylinders having consecutive firing order.

21. A method as claimed in claim 1 wherein said engine is a multi-cylinder engine having more than two cylinders and every second firing of each engine cylinder is stopped or altered to cause the required torque fluctuation in response to engine operator demand.

22. A method as claimed in claim 1 wherein the engine torque profile is varied such that said mean engine speed is idle speed.

23. A method as claimed in claim 1 wherein said torque variation is implemented for a certain time.

24. A method as claimed in claim 1 wherein the duration of variation in the engine torque profile is engine speed dependent.

25. A method as claimed in claim 1 wherein variation in the engine torque profile results in a non-periodic torque profile.

26. A method as claimed in claim 1 wherein the variation of torque profile is effected while the engine is shifting out of gear.

27. A method as claimed in claim 1 wherein said engine is a marine engine.

28. A control system for an internal combustion engine comprising means for sensing operator demand for a gear-shift, and means for varying the torque profile of said engine while maintaining the mean engine output torque to overcome forces resistive to gear-shift in response to sensing of said operator demand for a gear-shift.

29. A method as claimed in claim 1 wherein the engine is a multi cylinder engine and the varying of the torque profile is achieved by increasing the fuel supply to at least one cylinder and decreasing the fuel supply to at least another cylinder within one engine cycle.

30. A method of operation of an internal combustion engine comprising sensing an operator demand for a gear-shift and in response to said sensed operator demand, varying the engine torque profile while maintaining a mean engine speed to thereby enable said gear-shift to be effected.

31. A method of operation of an internal combustion engine comprising sensing an operator demand for a gear-shift and in response to said sensed operator demand, varying the engine torque profile such that said profile is non-periodic.

* * * * *